US007851111B2

(12) United States Patent
Hays et al.

(10) Patent No.: US 7,851,111 B2
(45) Date of Patent: Dec. 14, 2010

(54) IMAGING BELT WITH NANOTUBE BACKING LAYER, AND IMAGE FORMING DEVICES INCLUDING THE SAME

(75) Inventors: Dan A. Hays, Fairport, NY (US); Edward F. Grabowski, Webster, NY (US); Samir Kumar, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 566 days.

(21) Appl. No.: 11/496,532

(22) Filed: Jul. 31, 2006

(65) Prior Publication Data

US 2008/0026309 A1 Jan. 31, 2008

(51) Int. Cl.
*G03G 5/10* (2006.01)

(52) U.S. Cl. ..... 430/56; 430/66; 430/930; 399/90; 399/159; 399/162; 399/164

(58) Field of Classification Search ..... 430/56, 430/930, 66; 399/159, 90, 162, 164
See application file for complete search history.

(56) References Cited

U.S. PATENT DOCUMENTS

| | | | | |
|---|---|---|---|---|
| 4,402,593 | A * | 9/1983 | Bernard et al. | 399/159 |
| 4,654,284 | A * | 3/1987 | Yu et al. | 430/930 |
| 5,008,167 | A * | 4/1991 | Yu | 430/56 |
| 5,021,309 | A * | 6/1991 | Yu | 430/930 |
| 5,167,987 | A * | 12/1992 | Yu | 430/930 |
| 5,215,841 | A * | 6/1993 | Scharfe et al. | 430/58.65 |
| 5,382,486 | A | 1/1995 | Yu et al. | |
| 6,101,353 | A * | 8/2000 | Yu et al. | 399/165 |
| 6,303,254 | B1 * | 10/2001 | Yu et al. | 430/56 |
| 6,751,429 | B1 * | 6/2004 | Wing | 399/164 |
| 7,060,241 | B2 | 6/2006 | Glatkowski | |
| 2004/0091284 | A1 * | 5/2004 | Jaskowiak | 399/164 |

FOREIGN PATENT DOCUMENTS

| | | |
|---|---|---|
| EP | 1 617 300 A2 | 1/2006 |
| EP | 1 617 300 A3 | 7/2006 |

OTHER PUBLICATIONS

English language machine translation of JP 2006-084987 (Mar. 2006).*
Borsenberger, Paul. et al. Organic Photoreceptors for Imaging Systems. New York: Marcel-Dekker. (1993) pp. 6-17.*

(Continued)

*Primary Examiner*—Christopher RoDee
(74) *Attorney, Agent, or Firm*—MH2 Technology Law Group LLP

(57) ABSTRACT

An imaging belt comprises a substrate layer, an outer image layer and an inner anti-curl backing layer. The inner anti-curl backing layer, in turn, includes one or more carbon nanotubes disposed therein, together with an exposed backing layer surface. An image forming device includes the imaging belt. The image forming device is arranged to conductively couple the backing layer surface to an included ground source by means of one or more included conducting backer bars, one or more included grounding brushes, or any combination of included conducting backer bars and grounding brushes.

8 Claims, 3 Drawing Sheets

OTHER PUBLICATIONS

Commonly-assigned pending U.S. Appl. No. 11/167,158, filed Jun. 28, 2005 by Dan A. Hays and David J. Gervasi, entitled "Fuser and fixing members and process for making the same".

Commonly-assigned pending U.S. Appl. No. 11/238,112, filed Sep. 29, 2005 by Samir Kumar and Dan A. Hays, entitled "Synthetic carriers".

Publication: "Carbon nanotube based transparent conductive coatings", by Paul J. Glatkowski, Eikos Inc., 2 Master Drive, Franklin, Massachusetts 02038, believed to have been posted on the website http://www.eikos.com on May 16, 2003.

Ito Naomoto, JPN Abstract "Electrophotographic Photoreceptor" Non-Patent Literature, Publication No. 2006084987, Published Mar. 30, 2006.

* cited by examiner

FIG. 3A
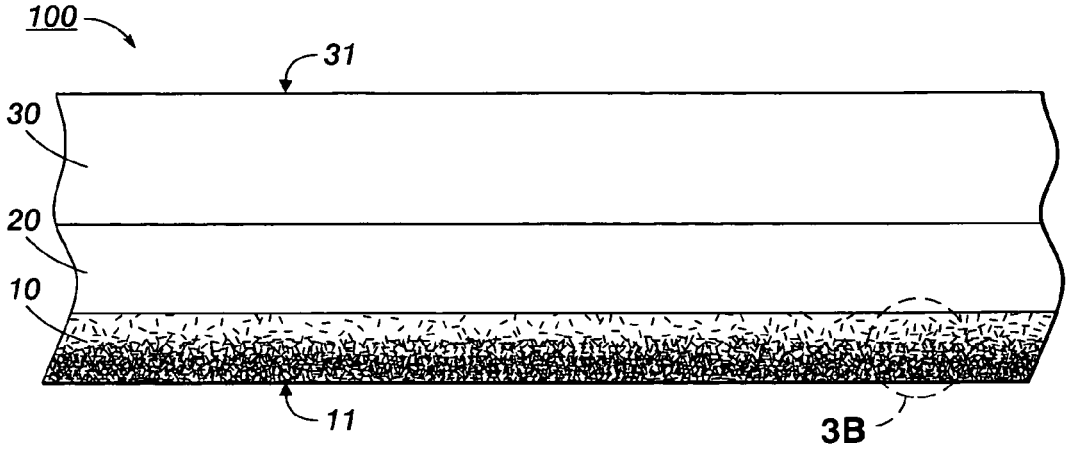
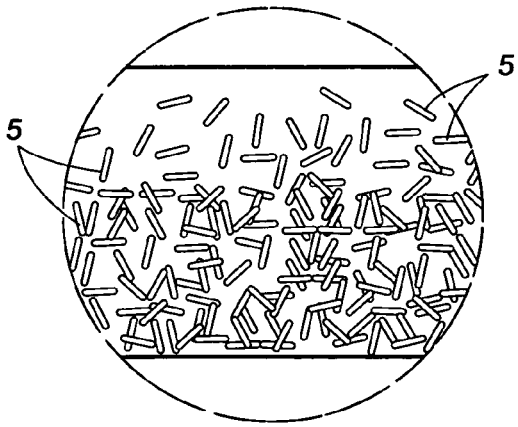
FIG. 3B

IMAGING BELT WITH NANOTUBE BACKING LAYER, AND IMAGE FORMING DEVICES INCLUDING THE SAME

INCORPORATION BY REFERENCE OF OTHER PATENTS, PENDING PATENT APPLICATIONS AND PUBLICATIONS

This application is related to the commonly-assigned pending application Ser. No. 11/167,158 filed on 28 Jun. 2005 by Dan A. Hays and David J. Gervasi, entitled "Fuser and fixing members and process for making the same", now pending, the disclosure of which pending application in its entirety hereby is totally incorporated herein by reference.

This application also is related to the commonly-assigned pending application Ser. No. 11/238,112 filed on 29 Sep. 2005 by Samir Kumar and Dan A. Hays, entitled "Synthetic carriers", now pending, the disclosure of which pending application in its entirety hereby is totally incorporated herein by reference.

The disclosure of the following U.S. patent in its entirety hereby is totally incorporated herein by reference: Paul J. Glatkowski, U.S. Pat. No. 7,060,241, "Coatings comprising carbon nanotubes and methods for forming same", issued Jun. 13, 2006.

The disclosure of the following publication in its entirety hereby is totally incorporated herein by reference: "Carbon nanotube based transparent conductive coatings", by Paul J. Glatkowski, Eikos, Inc., 2 Master Drive, Franklin, Mass. 02038, believed to have been posted on the website http://www.eikos.com on May 16, 2003.

BACKGROUND OF THE INVENTION

Organic belt photoreceptors are used by competitors for monochrome and color electrophotographic printing products. Solution coating of the active transport layer on the front side of a belt photoreceptor induces belt curl when the solvent evaporates. An anti-curl backcoating reduces the curl problem, but the backcoating needs to be transparent for electrical erase of the photoreceptor. Since typical conductive agents (e.g., carbon black) are optically absorbing, conductive fillers are not used in the backcoating. Consequently, an active neutralizing device is used to eliminate charge on the backcoating which otherwise increases belt drag. To eliminate the need for such devices, a transparent, conductive composite is desired for the backcoating. Thus, the proposal herein should be of value to both Xerox and competitors.

Since the backside transparent coatings used for photoreceptors in the Xerox iGen3 and Nuvera printers are insulating, active charge neutralizing devices are required to prevent electrostatic charge accumulation due to rubbing of the belt backside against drive and idler rolls, as well as backer bars that maintain critical gaps for different xerographic subsystems.

The backside of belt organic photoreceptors as used in monochrome and full-color electrophotographic printers is continually being contacted and rubbed by drive and idler rolls, as well as backer bars that maintain critical gaps between the photoreceptor and various electrophotographic subsystems. The active layers on the front side of the photoreceptor are typically coated from polymeric solvent solutions. The coatings are applied to a polymeric substrate for which a transparent conductive film has been deposited on the topside of the substrate. As the solvent evaporates from coatings, stresses are induced in the belt that causes it to undesirably curl. To counter the curling tendency, a solution coating is applied to the back of the substrate. This is referred to as an anti-curl backcoating. The backcoating typically consists of polycarbonate which is similar to the transport layer polymer for the front side coating, except the backside coating does not require the addition of hole transporting molecules. Thus, the thickness of the backcoating is typically only about half of the front coating such as, for example, ~15 mm versus ~30 mm.

To reduce drag forces acting on the backside of the belt moving against backerbars, additives on usually included in the anti-curl backcoating to increase the lubricity. Additives such as silica or Teflon in the range of 2 to 4% (percent) loading are typically used. Since the matrix polymeric material and additives tend to be insulating, the anti-curl backcoating will triboelectic charge. The charging increases the electrostatic drag force between the back side of the belt and stationary members such as the backer bars. The charging can be sufficient to actually cause belt slip on the drive rolls. To minimize this problem, active charge neutralizing devices are used to reduce the charging level of the anti-curl backcoating. For the iGen3 product, a carbon fiber brush in rubbing contact with the anti-curl backcoating is connected to a power supply to reduce the undesired triboelectric charging. For the Nuvera product, a conductive roll that can also be cleaned contacts the anti-curl backcoating.

Thus, there is a need for the present invention.

BRIEF SUMMARY OF THE INVENTION

In a first aspect of the invention, there is described an imaging belt comprising a substrate layer, an outer image layer and an inner backing layer, the backing layer including one or more carbon nanotubes disposed therein.

In a second aspect of the invention, there is described an image forming device including an imaging belt, the imaging belt comprising a substrate layer, an outer image layer and an inner backing layer, the backing layer including one or more carbon nanotubes disposed therein.

BRIEF DESCRIPTION OF THE SEVERAL VIEWS OF THE DRAWING

FIG. 3A is an attached cross-sectional view of the imaging belt 100 along the reference line 3 of FIG. 2. As shown, FIG. 3A depicts the backing layer 10. Also as shown, a portion of the backing layer 10 is depicted by reference number 3B.

FIG. 3B is an expanded or magnified view of the portion of the backing layer 10 that is depicted by reference number 3B in FIG. 3A.

DETAILED DESCRIPTION OF THE INVENTION

Figure 1:
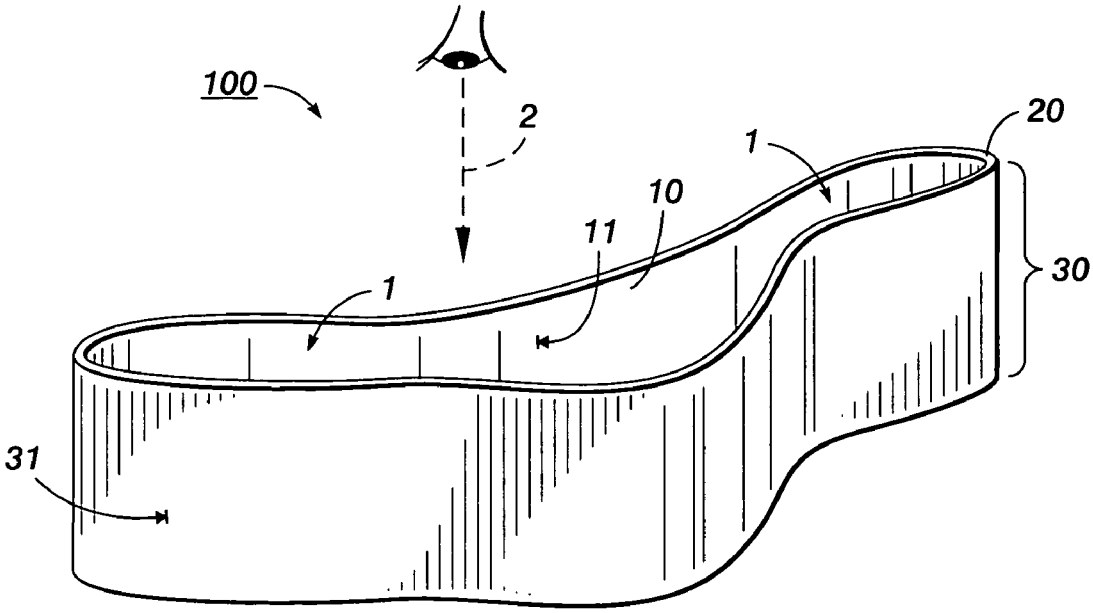
FIG. 1 is a detached elevated perspective view of an imaging belt 100 comprising a substrate layer 20, an outer image layer 30 and an inner backing layer 10.

The charge accumulation on the anti-curl backcoating is minimized by making the backcoating material sufficiently conducting. This eliminates the need for active charge neutralizing devices that add to the overall system cost. However, conventional additives for conductivity tend to be optically absorbing. Furthermore, the loading percentage to achieve the percolation limit for conductivity is sufficiently high that the mechanical properties of the composite material are compromised.

Thus, in accordance with the present invention, an imaging belt 100 comprises a substrate layer 20, an outer image layer 30 and an inner anti-curl backing layer 10. The inner anti-curl backing layer 10, in turn, includes one or more carbon nanotubes 5 disposed therein, together with an exposed backing layer surface 11. An image forming device 200 includes the imaging belt 100. The image forming device 200 is arranged to conductively couple the backing layer surface 11 to an included ground source 9 by means of one or more included conducting backer bars 40, one or more included grounding brushes 50, or any combination of included conducting backer bars 40 and grounding brushes 50.

Referring now to FIG. 1 there is a detached elevated perspective view of an imaging belt 100 comprising a substrate layer 20, an outer image layer 30 and an inner backing layer 10. The outer image layer 30, in turn, forms an exposed exterior image layer surface 31. The backing layer 10, in turn, forms an exposed interior backing layer surface 11. The backing layer surface 11, in turn, surrounds and defines an inner belt hollow 1. Also shown is a reference arrow 2 positioned above the imaging belt 100 and pointing downwards towards the belt hollow 1.

Figure 2:
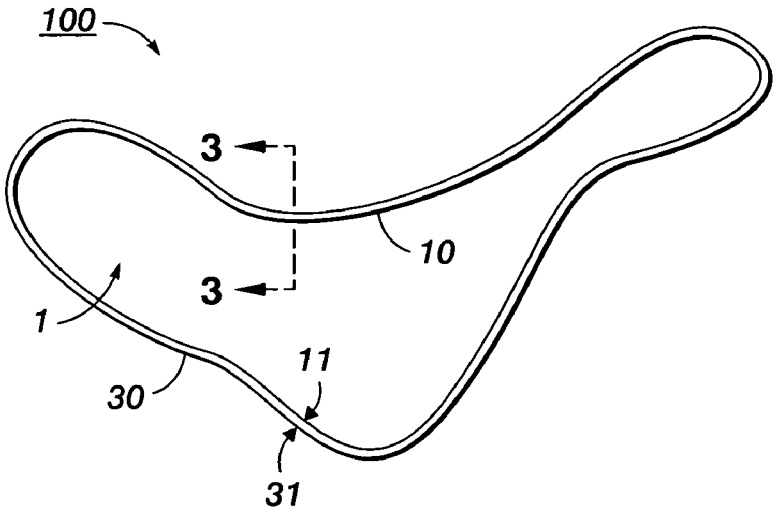
FIG. 2 is a detached elevated top-down "bird's eye" view of the imaging belt 100 in the direction of the reference arrow 2 of FIG. 1. As shown, FIG. 2 includes a reference line 3.

Referring now to FIG. 2 there is a detached elevated top-down "bird's eye" view of the imaging belt 100 in the direction of the reference arrow 2 of FIG. 1. As shown, a reference line 3 intersects the image layer surface 31 and the backing layer surface 11.

Referring now to FIG. 3A there is an attached cross-sectional view of the imaging belt 100 along the reference line 3 of FIG. 2. There is depicted the image layer 30, the substrate layer 20 and the backing layer 10. As shown, a portion of the backing layer 10 is depicted by reference number 3B.

Referring now to FIG. 3B there is an expanded or magnified view of the portion of the backing layer 10 that is depicted by reference number 3B in FIG. 3A. As shown, the backing layer 10 includes disposed therein one or more carbon nanotubes 5.

Figure 4:
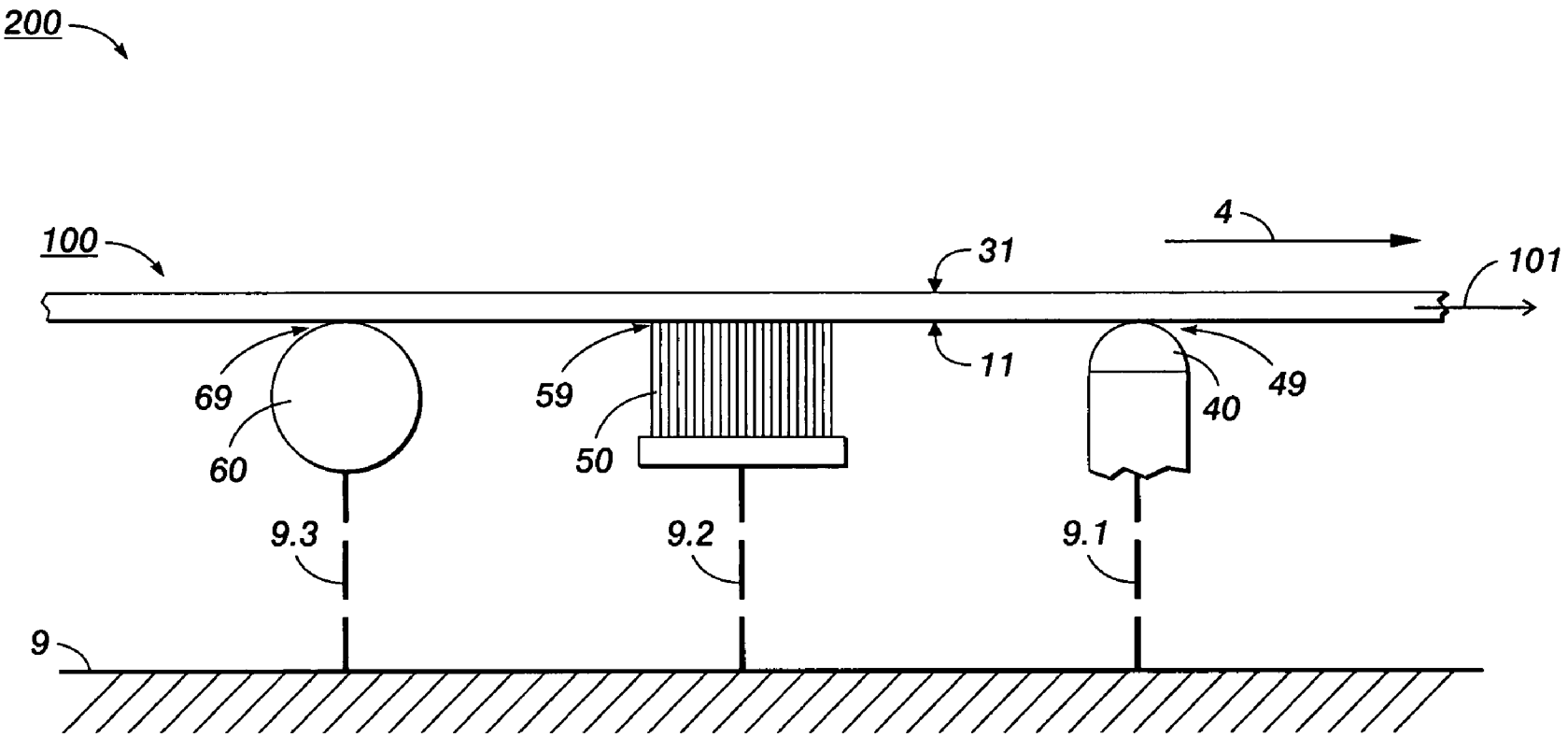
FIG. 4 depicts an image forming device 200 including the imaging belt 100.

Referring now to FIG. 4 there is depicted an image forming device 200 including the imaging belt 100. The process direction is depicted by the arrow 4. The motion of the imaging belt 100 in the process direction 4 is depicted by reference number 101. As shown, the image forming device 200 includes a ground source 9.

In one embodiment, the image forming device 200 comprises a copying machine.

In another embodiment, the image forming device 200 comprises a printing machine.

In still another embodiment, the image forming device 200 comprises a facsimile machine.

Still referring to FIG. 4, in one embodiment the image forming device 200 is arranged to couple the ground source 9 to the imaging belt 100 backing layer surface 11 by means of one or more included conducting backer bars 40. As shown, the ground source 9 is coupled to the backer bar 40 by means of a first ground path 9.1. The backer bar 40, in turn, is arranged to contact the backing layer surface 11. In FIG. 4 the contact of the backer bar 40 with the backing layer surface 11 is depicted by reference number 49. As a result of such backer bar 40-backing layer surface contact 49, the ground source 9 is thereby coupled to the imaging belt 100 backing layer surface 11.

Referring still to FIG. 4, in another embodiment the image forming device 200 is arranged to couple the ground source 9 to the imaging belt 100 backing layer surface 11 by means of one or more included conducting grounding brushes 50. As shown, the ground source 9 is coupled to the grounding brush 50 by means of a second ground path 9.2. The grounding brush 50, in turn, is arranged to contact the backing layer surface 11. In FIG. 4 the contact of the grounding brush 50 with the backing layer surface 11 is depicted by reference number 59. As a result of such grounding brush 50-backing layer surface contact 59, the ground source 9 is thereby coupled to the imaging belt 100 backing layer surface 11.

Yet referring to FIG. 4, in still another embodiment the image forming device 200 is arranged to couple the ground source 9 to the imaging belt 100 backing layer surface 11 by means of one or more included conducting grounding devices 60. As shown, the ground source 9 is coupled to the grounding device 60 by means of a third ground path 9.3. The grounding device 60, in turn, is arranged to contact the backing layer surface 11. In FIG. 4 the contact of the grounding device 60 with the backing layer surface 11 is depicted by reference number 69. As a result of such grounding device 60-backing layer surface contact 69, the ground source 9 is thereby coupled to the imaging belt 100 backing layer surface 11.

Thus there is presented an anti-curl backcoating layer 10 for an organic belt photoreceptor 100 that incorporates carbon nanotubes 5 as a polymeric filler in a composite material that possesses both electrical conductivity and optical transparency. The conductivity obtained with a low percentage of carbon nanotubes 5 obviates the need for active charge neutralizing devices that are used when the backcoating is an insulative material. The optical transparency enables light exposure from the backside layer 10 for electrically erasing the photoreceptor 100 during the cycling process.

As described herein, carbon nanotubes 5 are used as a filler to impart conductivity to the anti-curl backcoating layer 10. Carbon nanotubes ("CNT") 5 represent a new molecular form of carbon in which a single layer of atoms is rolled into a seamless tube that is on the order of 1 to 10 nanometers in diameter and up to hundreds of micrometers in length. Multi-walled nanotubes ("MWNT") were first discovered by Iijima of NEC Labs in 1991. Two years later, he discovered single-walled nanotubes ("SWNT"). Since then, nanotubes have captured the attention of researchers worldwide. Nanotubes exhibit extraordinary electrical, mechanical and thermal conductivity properties. The nanotubes can be either conducting or semi-conducting, depending on the chirality (twist) of the nanotubes. They are have yield stresses much higher than that of steel, and can be kinked without permanent damage. The thermal conductivity of CNT is much higher than that of copper, and comparable to that of diamond. The nanotubes can be fabricated by a number of methods including carbon arc discharge, pulsed laser vaporization, chemical vapor deposition ("CVD") and high pressure CO. Variants of nanotubes that contain only carbon include nanotubes with equal amounts of boron and nitrogen.

Since the aspect ratio (length to diameter ratio) of carbon nanotubes is so high, the percolation limit (approximately the inverse of the aspect ratio) for electrical conductivity is much lower than typical conductive fillers such as carbon black. The percolation limit for the addition of SWNT in epoxy is between only 0.1 to 0.2 wt %. This level of loading does not affect the other properties of the matrix material. For higher loadings, the conductivity increases by a factor of 104. Hyperion Catalysis International, Inc., 38 Smith Place, Cambridge, Mass. 02138 produces MWNT composite materials for a variety of applications that require conductive polymeric materials.

The paper "Carbon nanotube based transparent conductive coatings" by Paul J. Glatkowski of Eikos, Inc., 2 Master Drive, Franklin, Mass. 02038, describes a Nanoshield™ technology for carbon nanotube based transparent conductive coatings. Eikos, Inc. has demonstrated coatings with resistivity of 105 ohms/sq at an optical transmittance of 95%.

NOTE: The term "NANOSHIELD" is a trademark of the aforementioned Eikos, Inc.

See also U.S. Pat. No. 7,060,241 to the same Paul J. Glatkowski entitled "Coatings comprising carbon nanotubes and methods for forming same", issued Jun. 13, 2006, the disclosure of which patent hereinabove has been incorporated by reference, verbatim, and with the same effect as though the same disclosure were fully and completely set forth herein.

The anti-curl backcoating composite layer 10 containing the carbon nanotubes 5 can be grounded by either a conductive grounding brush/brushes 50 in contact with the coating, or grounded elements such as the backer bars 40 that can have sufficient conductivity to continually dissipate any charge accumulation on the backcoating layer 10.

Thus, there is described the first aspect of the invention, substantially as described hereinbelow, namely, an imaging belt 100 comprising a substrate layer 20, an outer image layer 30 and an inner backing layer 10, the backing layer 10 including one or more carbon nanotubes 5 disposed therein.

In one embodiment of the imaging belt 100, substantially as described hereinbelow, the imaging belt 100 of the backing layer 10 further comprises an anti-curl backing layer.

Also, there has been described the second aspect of the invention, substantially as described hereinbelow, namely, an image forming device 200 including an imaging belt 100, the imaging belt 100 comprising a substrate layer 20, an outer image layer 30 and an inner backing layer 10, the backing layer 10 including one or more carbon nanotubes 5 disposed therein.

In one embodiment of the image forming device 200, substantially as described hereinbelow, the backing layer 10 of the imaging belt 100 further comprises an anti-curl backing layer 10.

In a further embodiment of the image forming device 200, substantially as described hereinbelow, the imaging belt 100 inner backing layer 10 includes a backing layer surface 11 and the image forming device 200 is arranged to couple the backing layer surface 11 to an included ground source 9 by means of one or more included conducting backer bars 40.

In another embodiment of the image forming device 200, substantially as described hereinbelow, the imaging belt 100 inner backing layer 10 includes a backing layer surface 11 and the image forming device 200 is arranged to couple the backing layer surface 11 to an included ground source 9 by means of one or more included conducting grounding brushes 50.

In a still further embodiment of the image forming device 200, substantially as described hereinbelow, the imaging belt 100 inner backing layer 10 including a backing layer surface 11, the image forming device 200 arranged to couple the backing layer surface 11 to an included ground source 9 by means of at least one included conducting backer bar 40 together with at least one included conducting grounding brush 50.

In still another embodiment of the image forming device 200, substantially as described hereinbelow, the image forming device 200 comprises a copying machine.

In yet a still further embodiment of the image forming device 200, substantially as described hereinbelow, the image forming device 200 comprises a printing machine.

In yet still another embodiment of the image forming device 200, substantially as described hereinbelow, the image forming device 200 comprises a facsimile machine.

The table below lists the drawing element reference numbers together with their corresponding written description:

REF. NO.: DESCRIPTION

1 imaging belt hollow
2 reference arrow
3 reference line
3B reference number used to depict a portion of the imaging belt anti-curl backing layer 10
4 process direction
5 one or more carbon nanotubes
9 ground source
9.1 ground path
9.2 ground path
9.3 ground path
10 imaging belt anti-curl backing layer
11 imaging belt backing layer surface
20 imaging belt substrate layer
30 imaging belt image layer
31 imaging belt image layer surface
40 one or more conducting backer bars
49 backer bar contacting the backing layer surface
50 one or more conducting grounding brushes
59 grounding brush contacting the backing layer surface
60 one or more conducting grounding devices
69 grounding device contacting the backing layer surface
100 imaging belt
101 movement of imaging belt
200 image forming device While particular embodiments have been described hereinabove, alternatives, modifications, variations, improvements and substantial equivalents that are or may be presently unforeseen may arise to applicants or others skilled in the art. Accordingly, the appended claims as filed and as they may be amended are intended to embrace all such alternatives, modifications, variations, improvements and substantial equivalents.

What is claimed is:

1. An imaging belt comprising:

a substrate layer;

an outer image layer, wherein the outer image layer forms an exposed exterior image layer surface; and an optically transparent electrically conductive inner backing layer, wherein the backing layer forms an exposed interior backing layer surface, the backing layer including one or more carbon nanotubes disposed therein.

2. The imaging belt of claim 1, wherein the backing layer further comprises an anti-curl backing layer.

3. An imaging device comprising the imaging belt of claim 1, wherein the imaging device comprises one or more conducting backer bars in contact with the exposed interior backing layer surface, wherein the backing layer is grounded by means of the one or more conducting backer bars.

4. The imaging device of claim 3, further comprising one or more conducting grounding brushes in contact with the exposed interior backing layer surface, wherein the backing layer is grounded by means of one or more conducting grounding brushes.

5. The imaging device of claim 3, wherein the backing layer is grounded by means of at least one conducting backer bar together with at leas one conducting grounding brush in contact with the exposed interior backing layer surface.

6. A copying machine comprising the imaging belt of claim 1.

7. A printing machine comprising the imaging belt of claim 1.

8. A facsimile machine comprising the imaging belt of claim 1.

* * * * *